US007290410B2

(12) United States Patent
Meneghin et al.

(10) Patent No.: US 7,290,410 B2
(45) Date of Patent: Nov. 6, 2007

(54) DISASSEMBLE COVERING

(75) Inventors: Alfredo Meneghin, Anse (FR); Michel Therin, Lyons (FR)

(73) Assignee: Sofradim Production, Trevoux (FR)

( * ) Notice: Subject to any disclaimer, the term of this patent is extended or adjusted under 35 U.S.C. 154(b) by 0 days.

(21) Appl. No.: 11/409,026

(22) Filed: Apr. 24, 2006

(65) Prior Publication Data

US 2006/0248927 A1 Nov. 9, 2006

Related U.S. Application Data

(60) Provisional application No. 60/673,768, filed on Apr. 22, 2005.

(51) Int. Cl.
*D04B 21/10* (2006.01)

(52) U.S. Cl. ..... 66/195

(58) Field of Classification Search ..... 66/195, 66/198, 202, 191, 192, 193
See application file for complete search history.

(56) References Cited

U.S. PATENT DOCUMENTS 4,527,404 A * 7/1985 Nakagaki et al. ..... 66/202
4,748,078 A * 5/1988 Doi et al. ..... 66/169 A
5,732,572 A * 3/1998 Litton ..... 66/195
6,988,386 B1 * 1/2006 Okawa et al. ..... 66/195
2004/0034373 A1 2/2004 Schuldt-Hempe et al.

FOREIGN PATENT DOCUMENTS

| | | |
|---|---|---|
| DE | 100 43 396 C1 | 6/2002 |
| EP | 1 382 728 A | 1/2004 |
| FR | 2 244 853 | 4/1975 |
| FR | 2 453 231 | 10/1980 |
| GB | 2 051 153 | 1/1981 |

* cited by examiner

*Primary Examiner*—Danny Worrell
(74) *Attorney, Agent, or Firm*—Carter, DeLuca, Farrell & Schmidt, LLP

(57) ABSTRACT

The present invention relates to a knit made in one piece, based on an arrangement formed by at least two sheets of yarns, comprising at least one first sheet that defines a first chain structure and at least one or more non-meshing sheets, of partial weft, each of these non-meshing sheets defining a structure, which knit comprises at least one free chain yarn, a free chain yarn being defined as a chain yarn for which, along the entire longitudinal dimension of the knit, all yarn of said meshing sheets approaching said free chain yarn makes a 180 degree turn at this free chain yarn.

The invention also relates to a textile medical device obtained by unraveling of at least two free chain yarns of said knit.

The invention also relates to a method of production of said knit.

49 Claims, 3 Drawing Sheets

DISASSEMBLE COVERING

This application claims benefit of application Ser. No. 60/673,768 filed Apr. 22, 2005.

BACKGROUND OF THE INVENTION

The present invention relates to a prosthetic knit having zones that can be unraveled and permit easy separation of knitted bands or tapes in the direction of production of the knit. These bands or tapes can be used as textile medical devices that may or may not be implanted in the human body.

Textile devices that are not implantable include, for example, compresses, textile support dressings, etc. Devices that can be implanted in the human body include, for example, textile prostheses in general, such as wall reinforcements in parietal surgery for example, urethral support tapes in the treatment of female stress urinary incontinence, and in the treatment of pelvic floor disorders, which are generally found mainly in females and are also referred to as prolapses.

These textile devices generally need to have a specific strength suited to their application. This is particularly the case of textile prostheses implanted in the human body. Thus, parietal reinforcements are used to replace and/or strengthen and/or support the abdominal wall, at least on a temporary basis. Likewise, suburethral support tapes have to support the middle urethra, preferably in a definitive and permanent manner. The same applies to support implants used in the treatment of prolapses.

These textile prostheses therefore need to have a certain dimensional stability. To achieve this, these textile prostheses are generally subjected to a thermosetting step which increases their dimensional stability. The prostheses are then easier to manipulate.

However, the manipulation of tapes of small width, particularly with a view to a thermosetting operation, is particularly awkward and may lead to substantial numbers of tapes being discarded when they become unusable because the thermosetting has not been carried out properly. Moreover, thermosetting each tape on an individual basis means that the thermosetting of the tapes is not homogeneous and not reproducible.

DESCRIPTION OF THE PRIOR ART

It has been proposed to produce knits of large width that have the properties of break strength, elasticity and porosity desired for these implants, and then to cut the tapes or implants from these knits.

However, these support implants must be able to be cut into narrow tapes of the order of 1 cm in large lengths, for example of the order of 50 cm, without unraveling or curling. By "curling" we mean, in the context of the present application, the spontaneous rolling-up of the tape about its longitudinal axis under tension along its length. These implants have to retain sufficient mechanical properties in this form, particularly of strength, while at the same time limiting as far as possible the release of particles, that is to say yarn ends, when they are stressed. Preferably, these implants must also allow mechanically stable tissue anchoring.

Therefore, a problem posed by the cutting method lies in the fact that the edges of the implants are frayed. This results in release of particles, particularly in cases of elongation, and thus loss of yarns. Moreover, the macroporous elastic implants that are cut out are difficult to use without a protective sheath. The reason is that, because of their elasticity and non-smooth edges, these implants attach themselves to the patient's tissues and risk constituting a rasp in the event of a sharp bend, and they deform, curl up and release particles. It is for this reason that they are generally provided in a protective sheath, which complicates the surgical intervention.

There is therefore a need for a knit, in particular a macroporous prosthetic knit, which would make it possible to obtain textile medical devices, in particular support implants, for example in the form of tapes, that are easy to produce and to manipulate and do not have frayed edges, and which would provide tapes that have undergone homogeneous thermosetting.

SUMMARY OF THE INVENTION

The present invention aims to meet this need by making available a knit having zones that can be unraveled and permit easy separation, in the direction of production of the knit, of knitted bands or tapes, in particular macroporous bands or tapes, and made from a monofilament of biocompatible material, in particular by removal of one or more specific chain yarns, the removal of said yarn or yarns permitting separation of said knit into tapes with smooth edges and without risk of fraying.

The present invention relates to a knit, preferably an openworked prosthetic knit, made in one piece and based on an arrangement formed by at least two sheets of yarns, preferably made from a biocompatible polymer material, comprising at least one first sheet that defines a first chain structure and at least one or more non-meshing sheets, of partial weft, each of these non-meshing sheets defining a structure, wherein said knit comprises at least one free chain yarn, a free chain yarn being defined as a chain yarn for which, along the entire longitudinal dimension of the knit, all yarn of said non-meshing sheets approaching said free chain yarn makes a 180 degree turn at this free chain yarn.

The present invention also relates to the use of a knit as defined above, for obtaining a textile medical device, in particular a prosthetic product for surgical use, in particular for obtaining a support implant for the treatment of stress urinary incontinence and/or prolapses.

The invention further relates to a textile medical device which is obtained by unraveling of at least two free and preferably consecutive chain yarns of the knit as defined above, preferably along the length of the longitudinal dimension of said knit.

The present invention also relates to a method of production of a knit, preferably of an openworked prosthetic knit, made in one piece, based on an arrangement formed by at least two sheets of yarns, preferably of a biocompatible polymer material, which method comprises the following step:

production of a knit on a knitting machine or Raschel machine, with a first sheet and one or more non-meshing sheets, said first sheet being drawn continuously or intermittently and being obtained from one guide bar, the chart followed for knitting the yarns of said first sheet leading to the formation of a chain, said non-meshing sheets being drawn continuously or intermittently, each of said non-meshing sheets being obtained from one guide bar, the chart followed for knitting the yarns of each non-meshing sheet being such that for at least one yarn of the chain structure, called a free chain yarn, seen in the direction of production of the knit, all yarn of said non-meshing sheets approaching said free chain yarn makes a 180 degree turn at this free chain yarn.

The knit according to the invention permits production of a large number of homogeneous tapes, in particular tapes that have been thermoset homogeneously. The knit according to the invention, preferably produced in large width, for example a width ranging from 1.2 to 1.5 meters, is easy to manipulate and, therefore, to thermoset. Moreover, the thermosetting performed on a section of large width, for example a section that is from 1.2 to 1.5 m wide in the case of a knit according to the invention, is particularly homogeneous, and the textile medical devices, in particular the implants, obtained from this knit, in the form of tapes separated by unraveling of the free chain yarns, are also homogeneous and reproducible.

The textile medical device, in particular the support implant, according to the invention has excellent tensile strength and may have minimal elasticity and is therefore eminently suitable for production of a support implant for the treatment of stress urinary incontinence and prolapses, without any need to use a protective sheath.

Moreover, by virtue of its method of production, the textile medical device according to the invention has smooth, non-traumatic and stable edges, that is to say with no risk of fraying or of release of particles. Finally, all the textile medical devices, in particular all the tapes or implants, obtained from the same knit according to the invention have undergone homogeneous thermosetting and are easy to manipulate.

In the present application, "prosthetic knit" is understood as meaning a knit intended to be implanted in the human or animal body in the form of a prosthesis or any other component produced at least in part with said knit.

In the present application, "openworked knit" is understood as meaning a knit whose structure or structures determine holes or gaps within the thickness of the knit, these holes or gaps being able to constitute channels that open out on either side of the knit. An openworked knit of this kind, also called macroporous, permits better tissue integration.

The expression "meshing sheet" is understood, in the present application, as a sheet of yarns for which the chart followed for knitting the yarns leads to the formation of meshes. In a known manner, a sheet with a chain structure is a meshing sheet, whereas sheets of partial weft are non-meshing sheets.

In the present application, "free chain yarn" is understood as a chain yarn that is not completely crossed by any weft yarn, or, to put it another way, a chain yarn for which all weft yarn approaching and interacting with this chain yarn, for example by being linked with it, then makes a 180 degree turn at this chain yarn, and this applies along the entire longitudinal dimension of the knit.

In the present application

- the mass per unit area of a knit is measured according to ISO 3801,
- the breaking strength of a knit in the longitudinal direction and in the transverse direction is measured according to ISO 13934-1,
- the elongation under 2 daN in the longitudinal direction is measured according to ISO 13934-1.

In a preferred embodiment of the invention, the knit comprises at least one percent of free chain yarns spaced regularly or irregularly along the transverse dimension of the knit.

More preferably, the knit comprises at least ten percent of free chain yarns spaced regularly along the transverse dimension of the knit.

Advantageously, the knit according to the invention comprises a non-meshing sheet with the following chart: 0-0/2-2//.

In a preferred embodiment of the invention, the knit according to the invention comprises at least two non-meshing sheets. The reason for this is that the presence of two non-meshing sheets, in particular of two intersecting non-meshing sheets, that is to say sheets whose respective guide bars move symmetrically in relation to one another, offset from one another in the direction of production of the knit on the knitting machine, makes it possible to obtain tapes and/or implants exhibiting very good resistance to lateral compression. Thus, when the two opposite longitudinal edges of a textile medical device, in particular of a tape and/or implant, obtained from the knit according to the invention, are compressed, for example between two fingers, this textile medical device, in particular this tape and/or implant, retains significantly the same width. Preferably, the loss of width of a medical device, in particular of a tape and/or implant, according to the invention, under the effect of its two opposite longitudinal edges being compressed between two fingers, is less than 10%. The medical devices, in particular the tapes and/or implants, according to the invention are therefore particularly stable with respect to their manipulation and to their passage through possible auxiliary equipment (eyes of needles, cannulas, etc.) and through the patient's tissue (limitation of cord effect).

In a preferred embodiment of the invention, the knit comprises a first non-meshing sheet and a second non-meshing sheet, said first non-meshing sheet having the chart 1-1/3-3/2-2/0-0//, said second non-meshing sheet having the chart 3-3/2-2/0-0/1-1//.

Preferably, the distance between said free chain yarns, along the transverse dimension of the knit, ranges from 0.5 cm to 2 cm, preferably from 0.5 cm to 1.5 cm.

Preferably, the knit according to the invention is a prosthetic knit. Thus, preferably, the knit is made from monofilament or multifilament yarns of a biocompatible polymer material chosen from polypropylene, polyester, polyamide and mixtures thereof. Advantageously, said biocompatible polymer material is polypropylene.

In another embodiment, the knit according to the invention is made from monofilament or multifilament yarns of a biocompatible and bioabsorbable polymer material.

In yet another embodiment, the knit according to the invention is made from a mixture of biocompatible yarns that are bioabsorbable and of biocompatible yarns that are not bioabsorbable.

Preferably, the knit according to the invention is made from monofilament yarns having a diameter ranging from 0.05 mm to 0.15 mm, preferably of approximately 0.10 mm.

Preferably, the knit according to the invention has a thickness ranging from 0.20 mm to 0.40 mm, preferably of approximately 0.30 mm.

Preferably, the knit according to the invention is an openworked knit. Thus, in a preferred embodiment of the invention, the knit according to the invention comprises holes having a diameter ranging from 0.3 to 1.5 mm, preferably ranging from 0.3 to 0.9 mm. Such a knit permits production of a support implant that has good tissue anchoring.

Preferably, the knit according to the invention is thermoset.

Preferably, the textile medical device according to the invention has a width ranging from 0.5 cm to 2 cm, preferably ranging from 0.5 cm to 1.5 cm.

Advantageously, the textile medical device according to the invention has a mass per unit area ranging from 40 to 100 $g/m^2$, preferably from 50 to 75 $g/m^2$, and more preferably from 50 to 60 $g/m^2$.

Preferably, the textile medical device according to the invention has a thickness ranging from 0.20 mm to 0.40 mm, preferably of approximately 0.30 mm.

Preferably, the textile medical device according to the invention comprises holes having a diameter ranging from 0.3 to 1.5 mm, preferably ranging from 0.3 to 0.9 mm.

Preferably, the textile medical device according to the invention has a breaking strength, in the longitudinal direction and transverse direction, ranging from 20 to 90 N, preferably from 40 to 90 N, preferably from 55 to 75 N, more preferably from 60 to 70 N, measured according to ISO 13934-1.

Thus, the textile medical device according to the invention has excellent mechanical strength, or breaking strength, and at the same time quite a low mass per unit area. A textile medical device of this kind is particularly advantageous as a support implant, because it provides effective support of the organs to be treated and at the same time reduces to a minimum the mass of the implanted foreign body.

Preferably, the textile medical device according to the invention has an elongation under 2 daN, in the longitudinal direction, of less than or equal to 15%, more preferably of less than or equal to 10%, measured according to ISO 13934-1. Such a textile medical device is thus particularly stable dimensionally.

Preferably, the textile medical device according to the invention is an openworked prosthetic device and constitutes a support implant for the treatment of stress urinary incontinence and/or prolapses.

Moreover, since the textile medical device according to the invention preferably corresponds to a zone of the knit according to the invention that is situated between two consecutive free chain yarns, it does not comprise free chain yarns. There is therefore no risk of its unraveling.

Preferably, the knit according to the invention is produced by a method comprising the following step:

production of a knit on a knitting machine or Raschel machine, with a first sheet and one or more non-meshing sheets, said first sheet being drawn continuously or intermittently and being obtained from one guide bar, the chart followed for knitting the yarns of said first sheet leading to the formation of a chain, said non-meshing sheets being drawn continuously or intermittently, each of said non-meshing sheets being obtained from one guide bar, the chart followed for knitting the yarns of each non-meshing sheet being such that for at least one yarn of the chain structure, called a free chain yarn, seen in the direction of production of the knit, all yarn of said non-meshing sheets approaching said free chain yarn makes a 180 degree turn at this free chain yarn.

Preferably, the chart followed for knitting the yarns of each non-meshing sheet is such that for at least one per cent, preferably for at least ten per cent, of the yarns of the chain structure, called free chain yarns, seen in the direction of production of the knit, all yarn of said non-meshing sheets approaching said free chain yarns makes a 180 degree turn at these free chain yarns.

Therefore, according to the method of manufacture of the knit according to the invention, all chain yarns, be they free or not, are knitted with the same guide bar.

In one embodiment of the method according to the invention, a single non-meshing sheet is used, the yarns of the first sheet for the chain structure being knitted according to a chart 1-0/0-1//, the yarns of the non-meshing sheet being knitted according to a chart 0-0/2-2//.

Preferably, the guide bar of the first sheet is drawn continuously and full, and the guide bar of the non-meshing sheet is drawn continuously and full.

In a preferred embodiment of the method according to the invention, at least two non-meshing sheets are used. Preferably, two non-meshing sheets are used, the guide bars of said two non-meshing sheets moving symmetrically in relation to one another, offset from one another in the direction of production of the knit.

Advantageously, a first non-meshing sheet and a second non-meshing sheet are used, the yarns of the first sheet for the chain structure being knitted according to a chart 1-0/0-1//, the yarns of the first non-meshing sheet being knitted according to a chart 1-1/3-3/2-2/0-0//, the yarns of the second non-meshing sheet being knitted according to a chart 3-3/2-2/0-0/1-1//.

Preferably, the guide bar of the first sheet for the chain structure is drawn continuously and full, the guide bar of the first non-meshing sheet is drawn continuously and 1 full, 1 empty, 3 full, 1 empty, 1 full, 3 empty, and the guide bar of the second non-meshing sheet is drawn continuously and 1 full, 1 empty.

Advantageously, the two guide bars of the two non-meshing sheets move in partial weft under three needles, symmetrically in relation to one another, and offset from one another in the direction of production of the knit. Such knitting, with the weft bars moving symmetrically in relation to one another and thus intersecting, makes it possible to obtain better holding of the chains and thus better resistance to lateral compression of the implants and/or tapes that are obtained from the knit according to the invention.

The knit, on leaving the knitting machine, is preferably subjected to a thermosetting operation. The knit is therefore easy to manipulate, in particular for the unraveling step. Moreover, all the tapes and implants obtained from the same thermoset knit exhibit a homogenous thermosetting, making it possible to better guarantee the homogeneity of the physico-mechanical properties from one tape to another after unraveling.

BRIEF DESCRIPTION OF THE DRAWINGS

The invention will be better understood from the following description in which reference is made to the attached drawings, where.

DESCRIPTION OF THE PREFERRED EMBODIMENTS

Figure 1:
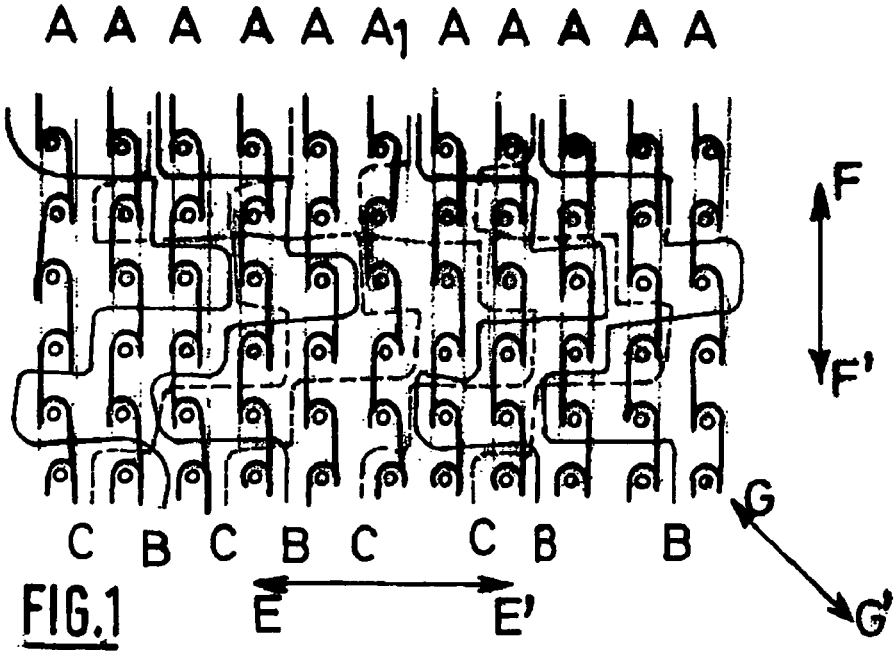
FIG. 1 is a simplified schematic representation of a knit comprising a first sheet of chain structure, and two non-meshing sheets.

In FIG. 1, for a knit according to the invention, E-E' defines the transverse direction or dimension of the knit, F-F' the longitudinal direction or dimension of the knit, and G-G' the diagonal direction or dimension of the knit.

This figure shows the movements of the chain yarns and of the weft yarns for a knit according to the invention having a chain sheet and two non-meshing sheets. The yarns A and A1 of the chain structure are indicated by thick solid lines. The yarn A1 is a free chain yarn within the meaning of the present invention. Yarns A are chain yarns which are not free within the meaning of the present invention. The yarns of the first non-meshing sheet are indicated by thin solid lines: these are the yarns B. The yarns of the second non-meshing sheet are shown by a broken line: these are the yarns C.

In this example, the first guide bar, corresponding to the chain structure, is drawn continuously and full.

The second guide bar, corresponding to the first non-meshing sheet and to the yarns B, is drawn continuously and 1 full, 1 empty, 3 full, 1 empty, 1 full, 3 empty. The third guide bar, corresponding to the second non-meshing sheet and to the yarns C, is drawn continuously and 1 full, 1 empty.

The knitting charts for these three sheets are as follows:

the chain sheet (yarns A and A1): 1-0/0-1//, the first non-meshing sheet (yarns B): 1-1/3-3/2-2/0-0//, the second non-meshing sheet (yarns C): 3-3/2-2/0-0/1-1//.

Thus, the chain yarn A1, as it is shown in FIG. 1, is not completely crossed by any weft yarn, or, to put it another way, all weft yarn, that is to say all yarn B or C, approaching said chain yarn A1, is optionally linked with said chain yarn A1, and then makes a 180 degree turn at this chain yarn A1.

The free chain yarn A1 can thus be unraveled without affecting the adjacent chain yarns A, which are not free within the meaning of the present application, and, therefore, without destructuring the knit on either side of this yarn A1. By pulling the chain yarn A1, the part of the knit situated to the left of this yarn A1 is separated from the part situated to the right of this yarn A1 without unraveling these two parts.

Moreover, because all weft yarn approaching the yarn A1 makes a 180 degree turn at this yarn A1, the edges of the separated parts have only one yarn B or C making an 180 degree turn and for this reason are smooth. No fraying takes place.

Figure 3:
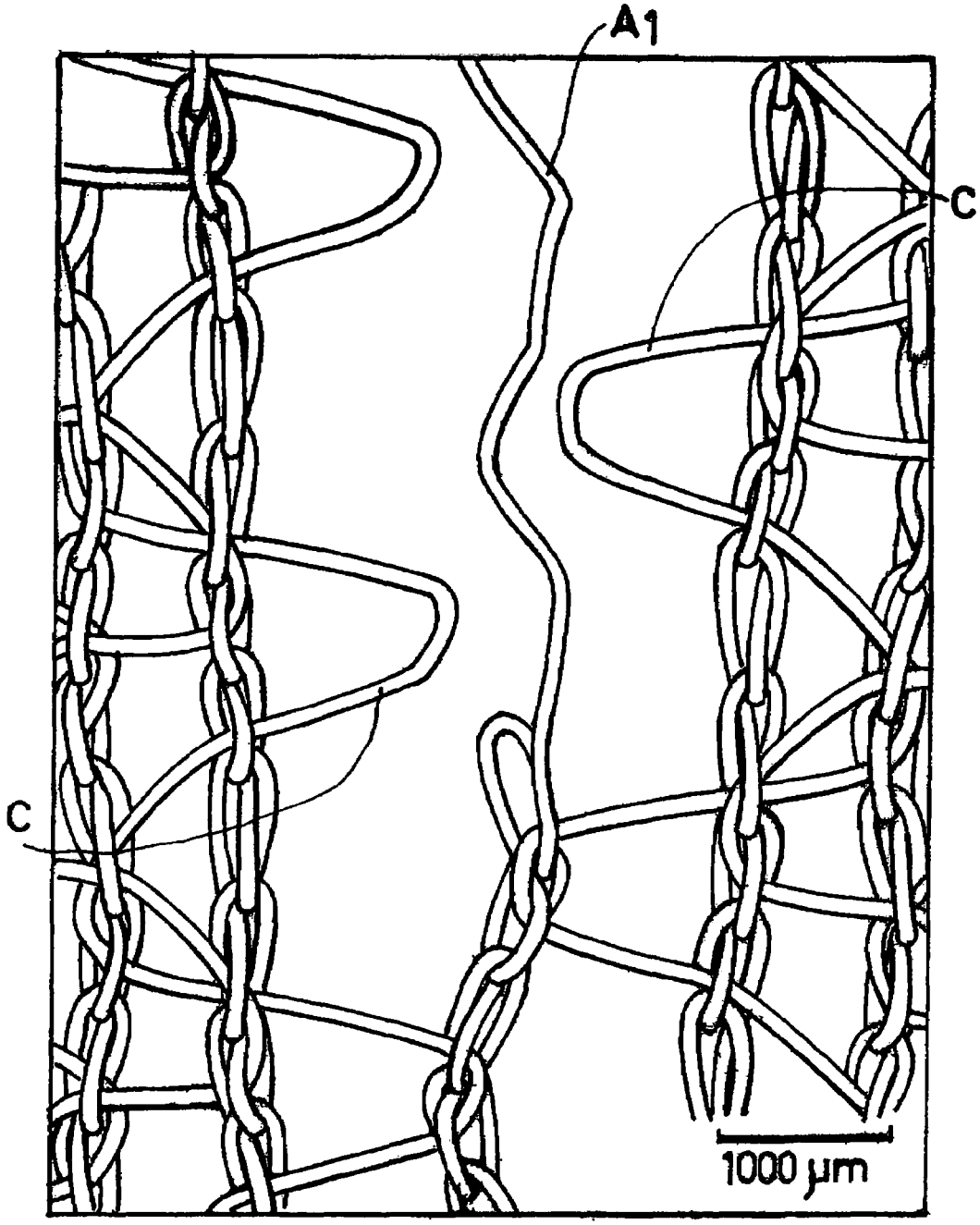
FIG. 3 is a drawing of a view taken with a Hitachi S 800 scanning electron microscope at a magnification of ×20, showing the unraveling of a free chain yarn in a knit according to the invention.

This unraveling of a free chain yarn A1 in a knit according to the invention can be seen in FIG. 3, which is the drawing of a photograph, taken with the Hitachi S 800 scanning electron microscope, at a magnification of ×20, of a zone of unraveling of a knit according to FIG. 1 and of Example 1 of the present application. In the upper part of the figure, the yarn A1 is unraveled and the parts of the knit on either side of this yarn A1 have not been destructured. Their edges are smooth: only one yarn C makes a 180 degree turn. No yarn of the knit is cut or frayed. As appears clearly from FIG. 3, thanks to the specific threading of the yarns of the non-meshing sheets, the yarn C doing a one hundred and eighty degree turn at the edge of a separated part is integral with the core of said separated part. In this figure, the yarn A1 is in the process of unraveling. Thus, at the bottom of the figure, the yarn A1 is still meshed with the yarns C approaching it.

At the end of the unraveling, that is to say when the yarn A1 has been unraveled along the entire length of the knit, the yarn A1 is removed from the knit according to the invention, and the two parts of the knit situated on either side of this yarn A1 are completely separated. By unraveling a second free chain yarn in the same way, a tape is separated completely from the knit. The distribution of the yarns A1 allows the width of each tape to be determined with great precision.

Figure 2:
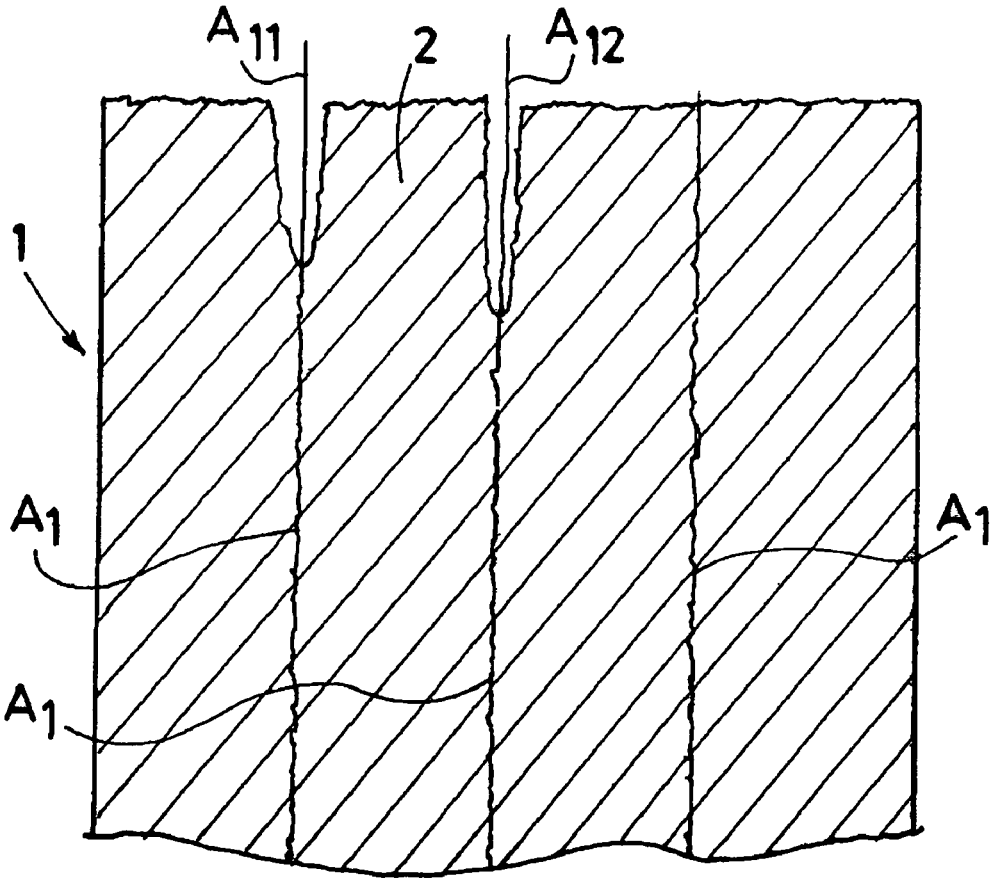
FIG. 2 represents a prosthetic knit according to the invention in which two free chain yarns are partially unraveled.

FIG. 2 is a schematic representation of a knit 1 according to the invention for which the free chain yarns A1 are spaced regularly within the knit. Two of these yarns, the yarns A11 and A12, are partially unraveled. Thus, by completely unraveling these free chain yarns A11 and A12, a textile medical device 2 according to the invention is obtained.

Figure 4:
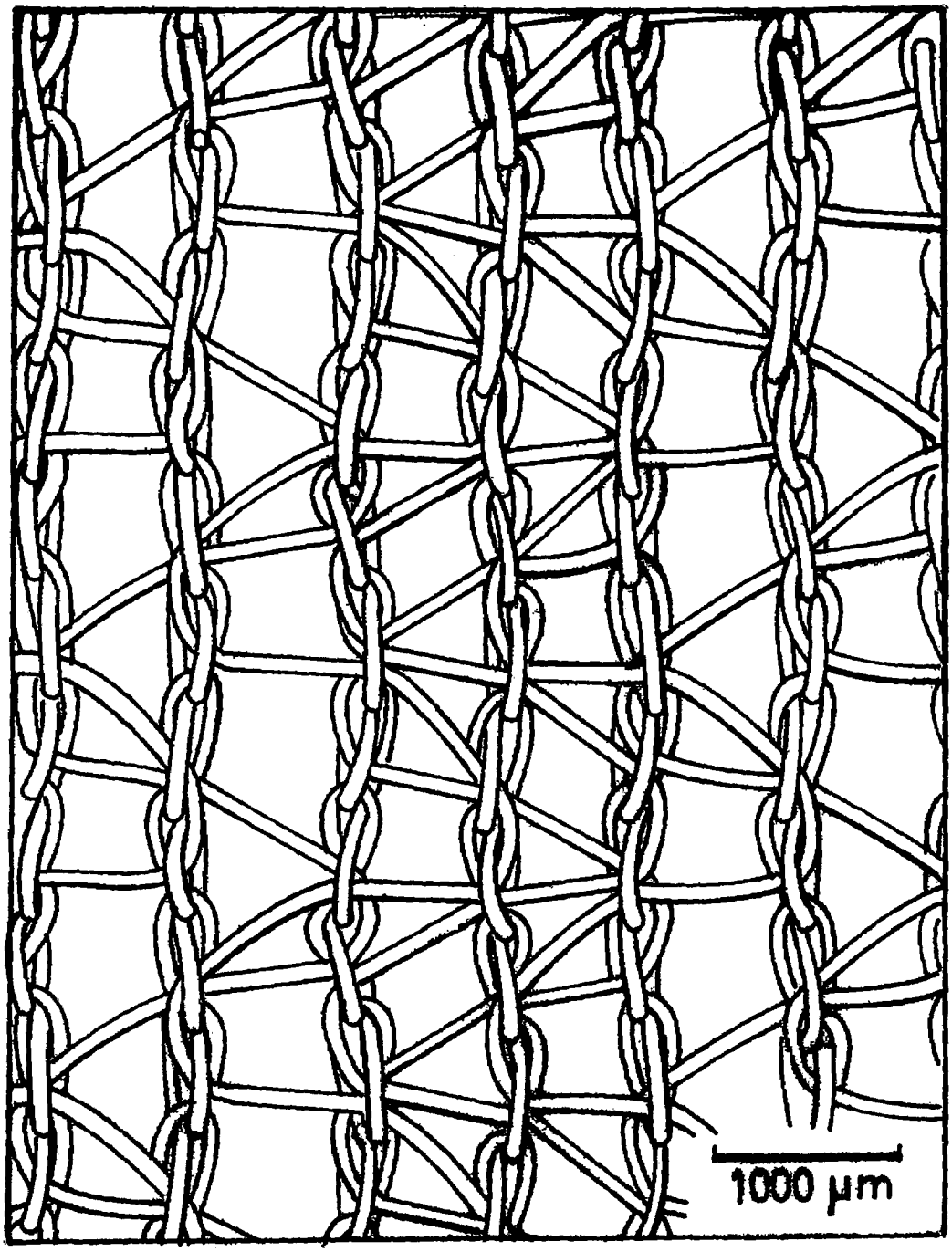
FIG. 4 is a drawing of a view taken with a Hitachi scanning electron microscope at a magnification of ×20, showing the core of an implant according to the invention.

The core of a textile medical device according to the invention is shown in FIG. 4, which is the drawing of a photograph taken with the Hitachi S 800 scanning electron microscope at a magnification of ×20. The core of a textile medical device according to the invention preferably corresponds to a zone of the knit according to the invention situated between two consecutive free chain yarns. Therefore, the textile medical device itself does not comprise free chain yarns. There is therefore no risk of its unraveling.

EXAMPLE

A knit according to the invention was produced from a monofilament yarn of polypropylene, diameter 0.10 mm, on a Raschel machine, with a chain sheet and two non-meshing sheets, the following charts being used for the various sheets:

the chain sheet: 1-0/0-1//, the first non-meshing sheet: 1-1/3-3/2-2/0-0//, the second non-meshing sheet: 3-3/2-2/0-0/1-1//.

The first guide bar, corresponding to the chain structure, was drawn continuously and full. The second guide bar, corresponding to the first non-meshing sheet, of partial weft, was drawn continuously and 1 full, 1 empty, 3 full, 1 empty, 1 full, 3 empty. The third guide bar, corresponding to the second non-meshing sheet, of partial weft, was drawn continuously and 1 full, 1 empty. The two partial wefts were drawn so as to move under nine chain yarns, by which means it was possible to finally obtain tapes separated by approximately 1 cm of width each. Therefore, in this example, 1 chain yarn in 10, that is to say ten per cent, was a free chain yarn within the meaning of the invention.

The gauge used was 24 needles.

The guide bars of the two non-meshing sheets moved in partial weft under three needles, symmetrically in relation to one another, offset from one another in the direction of production of the knit.

This knit corresponds to the structure represented in FIG. 1 of the present application.

On leaving the knitting machine, the knit was subjected to a thermosetting operation.

The knit had the following characteristics:

thickness: approximately 0.3 mm, diameter of the meshes: approximately 1 mm.

Tapes were obtained from this knit by unraveling at least two consecutive free chain yarns. The tapes had the following characteristics:

thickness: approximately 0.3 mm, diameter of the meshes: approximately 1 mm, width: approximately 1 cm, mass per unit area: approximately 50 g/m$^2$, breaking strength measured by the method according to ISO 13934-1 on a tape with a width of 1 cm and a length of 20 cm: 66 N.

The tape thus obtained by unraveling of at least two free, and preferably consecutive, chain yarns of the knit according to the invention has excellent tensile strength and is thus eminently suitable for use as, or for production of, a support implant for treating stress urinary incontinence and prolapses.

For example, an implant measuring 20 cm in length, or 30 cm in length, or even 40 cm in length, can be prepared from this tape.

Moreover, by virtue of its method of production, this implant has edges, in particular longitudinal edges, which are smooth and do not cause trauma. Finally, all the tapes or implants obtained from the same knit have undergone homogeneous thermosetting and are easy to manipulate.

The invention claimed is:

1. A method of producing a knit made in one piece, based on an arrangement formed by at least two sheets of yarns, which method comprises the following step: producing a knit comprising a first sheet and one or more non-meshing sheets, said first sheet being drawn continuously or intermittently and being obtained from one guide bar, following a chart for knitting the yarns of said first sheet leading to the formation of a chain structure having at least one free chain yarn, said non-meshing sheets being drawn continuously or intermittently, each of said non-meshing sheets being obtained from one guide bar, following a chart for knitting the yarns of each non-meshing sheet wherein all yarn of said non-meshing sheets approaching said free chain yarn makes a 180 degree turn at said free chain yarn.

2. The method as claimed in claim 1, wherein the knit comprises at least one percent of free chain yarns spaced regularly or irregularly along the transverse dimension of the knit.

3. The method as claimed in claim 1, wherein the yarns of the first sheet for the chain structure being knitted according to a chart 1-0/0-1//, the yarns of the non-meshing sheet being knitted according to a chart 0-0/2-2//.

4. The method as claimed in claim 3, wherein the guide bar of the first sheet is drawn continuously and full, and the guide bar of the non-meshing sheet is drawn continuously and full.

5. The method as claimed in claim 1, wherein at least two non-meshing sheets are used.

6. The method as claimed in claim 5, wherein the guide bars of said two non-meshing sheets moving symmetrically in relation to one another, offset from one another in the direction of production of the knit.

7. The method as claimed in claim 5, wherein the yarns of the first sheet for the chain structure being knitted according to a chart 1-0/0-1//, the yarns of the first non-meshing sheet being knitted according to a chart 1-1/3-3/2-2/0-0//, the yarns of the second non-meshing sheet being knitted according to a chart 3-3/2-2/0-0/1//.

8. The method as claimed in claim 7, wherein the guide bar of the first sheet for the chain structure is drawn continuously and full, the guide bar of the first non-meshing sheet is drawn continuously and 1 full, 1 empty, 3 full, 1 empty, 1 full, 3 empty, and the guide bar of the second non-meshing sheet is drawn continuously and 1 full, 1 empty.

9. The method as claimed in claim 8, wherein the two guide bars of the first and second non-meshing sheets move in partial weft under three needles, symmetrically in relation to one another, and offset from one another in the direction of production of the knit.

10. The method as claimed in claim 1, further comprising the step of subjecting the knit to a thermosetting operation.

11. A knit obtained by the method according to claim 1.

12. A knit made in one piece, based on an arrangement formed by at least two sheets of yarns, comprising at least one first sheet that defines a first chain structure and at least one or more non-meshing sheets, of partial weft, each of these non-meshing sheets defining a structure, wherein said knit comprises at least one free chain yarn, a free chain yarn positioned along the entire longitudinal dimension of the knit, all yarn of said non-meshing sheets approaching said free chain yarn makes a 180 degree turn at the free chain yarn.

13. The knit as claimed in claim 12, which knit comprises at least one percent of free chain yarns spaced regularly or irregularly along the transverse dimension of the knit.

14. The knit as claimed in claim 12, which knit comprises at least ten percent of free chain yarns spaced regularly along the transverse dimension of the knit.

15. The knit as claimed in claim 12, which knit comprises a non-meshing sheet with the following chart: 0-0/2-2//.

16. The knit as claimed in claim 12, which knit comprises at least two non-meshing sheets.

17. The knit as claimed in claim 16, which knit comprises a first non-meshing sheet and a second non-meshing sheet, said first non-meshing sheet having the chart 1-1/3-3/2-2/0-0//, said second non-meshing sheet having the chart 3-3/2-2/0-0/1-1//.

18. The knit as claimed in claim 12, wherein the distance between said free chain yarns, along the transverse dimension of the knit, ranges from 0.5 cm to 2 cm.

19. The knit as claimed in claim 12, which knit is a prosthetic knit.

20. The knit as claimed in claim 19, which knit is made from yarns of a biocompatible polymer material.

21. The knit as claimed in claim 20 which knit is made from monofilament or multifilament yarns of a biocompatible polymer material chosen from polypropylene, polyester, polyamide and mixtures thereof.

22. The knit as claimed in claim 21, wherein said biocompatible polymer material is polypropylene.

23. The knit as claimed in claim 20, which knit is made from monofilament or multifilament yarns of a biocompatible and bioabsorbable polymer material.

24. The knit as claimed in claim 20, which knit is made from a mixture of biocompatible yarns that are bioabsorbable and of biocompatible yarns that are not bioabsorbable.

25. The knit as claimed in claim 12, which knit is made from monofilament yarns having a diameter ranging from 0.05 mm to 0.15 mm.

26. The knit as claimed in claim 12, which knit has a thickness ranging from 0.20 mm to 0.40 mm.

27. The knit as claimed in claim 12, which knit is openworked.

28. The knit as claimed in claim 27, which knit comprises holes having a diameter ranging from 0.3 to 1.5 mm.

29. The knit as claimed in claim 12, which knit is thermoset.

30. A textile medical device which is obtained by unraveling of at least two free chain yarns of the knit as claimed in claim 11, along the length of the longitudinal dimension of said knit.

31. The textile medical device as claimed in claim 30, which textile medical device has a width ranging from 0.5 cm to 2 cm.

32. The textile medical device as claimed in claim 30, which textile medical device has a mass per unit area ranging from 40 to 100 g/m$^2$.

33. The textile medical device as claimed in claim 30, which textile medical device has a thickness ranging from 0.20 mm to 0.40 mm.

34. The textile medical device as claimed in claim 30, which textile medical device comprises holes having a diameter ranging from 0.3 to 1.5 mm.

35. The textile medical device as claimed in claim 30, which textile medical device has a breaking strength, in the longitudinal direction and transverse direction, ranging from 20 to 90 N.

36. The textile medical device as claimed in claim 30, which textile medical device has an elongation under 2 daN, in the longitudinal direction, of less than or equal to 15.

37. The textile medical device as claimed in claim 30, which textile medical device is an openworked prosthetic device and constitutes a support implant for the treatment of stress urinary incontinence and/or prolapses.

38. The knit as claimed in claim 12, wherein the distance between said free chain yarns, along the transverse dimension of the knit, ranges from 0.5 cm to 1.5 cm.

39. The knit as claimed in claim 12, which knit is made from monofilament yarns having a diameter of approximately 0.10 mm.

40. The knit as claimed in claim 12, which knit has a thickness ranging from of approximately 0.30 mm.

41. The knit as claimed in claim 27, which knit comprises holes having a diameter ranging from 0.3 to 0.9 mm.

42. The textile medical device as claimed in claim 30, which textile medical device has a width ranging from 0.5 cm to 1.5 cm.

43. The textile medical device as claimed in claim 30, which textile medical device has a mass per unit area ranging from 50 to 75 g/m$^2$.

44. The textile medical device as claimed in claim 30, which textile medical device has a thickness of approximately 0.30 mm.

45. The textile medical device as claimed in claim 30, which textile medical device comprises holes having a diameter ranging from 0.3 to 0.9 mm.

46. The textile medical device as claimed in claim 30, which textile medical device has a breaking strength, in the longitudinal direction and transverse direction, ranging from 40 to 90 N.

47. The textile medical device as claimed in claim 30, which textile medical device has a breaking strength, in the longitudinal direction and transverse direction, ranging from 55 to 75 N.

48. The textile medical device as claimed in claim 30, which textile medical device has a breaking strength, in the longitudinal direction and transverse direction, ranging from 60 to 70 N.

49. The textile medical device as claimed in claim 30, which textile medical device has an elongation under 2 daN, in the longitudinal direction, of less than or equal to 10.

* * * * *